US008430467B2

(12) United States Patent
Zhang

(10) Patent No.: US 8,430,467 B2
(45) Date of Patent: Apr. 30, 2013

(54) LIQUID EJECTING APPARATUS

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 268 days.

(21) Appl. No.: 13/025,339

(22) Filed: Feb. 11, 2011

(65) Prior Publication Data

US 2011/0242171 A1 Oct. 6, 2011

(30) Foreign Application Priority Data

Mar. 30, 2010 (JP) ..... 2010-077521

(51) Int. Cl.
*B41J 29/38* (2006.01)

(52) U.S. Cl.
USPC ..... 347/10

(58) Field of Classification Search ..... 347/6, 9–11
See application file for complete search history.

(56) References Cited

U.S. PATENT DOCUMENTS 6,598,950 B1 * 7/2003 Hosono et al. ..... 347/11
7,862,135 B2 * 1/2011 Zhang ..... 347/10

FOREIGN PATENT DOCUMENTS

JP 08-085208 4/1996
JP 3412682 B2 6/2003

* cited by examiner

*Primary Examiner* — An Do
(74) *Attorney, Agent, or Firm* — Workman Nydegger

(57) ABSTRACT

An ejection pulse DP sequentially and continuously includes an expansion phase p1 where a voltage changes so as to cause a pressure chamber to expand, an expansion hold phase p2 where a potential at an end edge of the expansion phase is maintained for a predetermined time, a contraction phase where the voltage changes so as to cause the pressure chamber to contract, and a time t1 between a start edge and the end edge of the expansion phase and a time t2 between a start edge and an end edge of the contraction phase are specified in the following range, respectively:

$$Tc/3 \leqq t1 \leqq Tc \quad \text{(A)}$$

$$Tc/3 \leqq t2 \leqq Tc \quad \text{(B).}$$

6 Claims, 7 Drawing Sheets

LIQUID EJECTING APPARATUS

BACKGROUND OF THE INVENTION

The entire disclosure of Japanese Patent Application No. 2010-77521, filed Mar. 30, 2010 is expressly incorporated herein by reference.

1. Technical Field

The present invention relates to a liquid ejecting apparatus that drives a pressure generator with an ejection pulse to thereby eject a liquid through a nozzle.

2. Related Art

A liquid ejecting apparatus currently known in the art drives a pressure generator such as a piezoelectric vibrator or a heating phase by applying an ejection drive pulse to the piezoelectric vibrator or heating phase. The ejection drive pulse causes the piezoelectric vibrator or heating phase to create pressure fluctuation of a liquid in a pressure chamber, which in turn causes the liquid to be ejected through a nozzle communicating with the pressure chamber. For example, in a printer disclosed in Japanese Patent No. 3412682, a drive pulse (drive waveform) is employed that includes a preparatory expansion process where a meniscus in the nozzle is drawn inward as much as possible toward the pressure chamber, a hold process where such a state is maintained as a standby state for a timing for ejecting an ink droplet, a first contraction process where the pressure chamber contracts thereby ejecting the ink droplet, and a second contraction process where a retracting action of the meniscus caused by a reaction of the ejection is suppressed. Thus, by contracting the pressure chamber after inwardly drawing the meniscus toward the pressure chamber in the expansion process, the ink droplet can be ejected utilizing a reaction of the retracting action of the meniscus.

In the liquid ejecting apparatus a phenomenon occurs wherein a rear portion of the ejected liquid droplet with respect to the moving direction stretches like a tail, known as tail drag. Such tail drag may create an irregular landing shape (dot shape) of the liquid droplet on a landing target. More specifically, although it is preferable that the landing shape assumes a circular or elliptical shape of a size specified according to desired image quality or performance level of the device, in the case where a part or whole of the tail flies separately from the main portion of the liquid droplet forming a satellite droplet, the satellite droplet may land on the landing target at a position separate from the main liquid droplet. Such irregularity of the landing shape results in degradation in image quality, for example in the case where an image is recorded on recording paper by a printer.

BRIEF SUMMARY OF THE INVENTION

An advantage of some aspects of the invention is that a liquid ejecting apparatus is provided that includes a liquid ejection head including a pressure chamber in which a liquid is stored, a nozzle communicating with the pressure chamber and through which the liquid is ejected, and a pressure generator that applies pressure fluctuation to the liquid in the pressure chamber; and an ejection pulse generator that generates an ejection pulse that drives the pressure generator. The ejection pulse sequentially includes a first voltage change phase where a voltage is changed so as to expand the pressure chamber, a hold phase where an end edge potential of the first voltage change phase is maintained for a predetermined period, a second voltage change phase where the voltage is changed so as to contract the pressure chamber expanded in the first voltage change phase; and a time t1 between a start edge and the end edge of the first voltage change phase, and a time t2 between a start edge and an end edge of the second voltage change phase are specified in the following range:

$$Tc/3 \leqq t1 \leqq Tc \quad \text{(A)}$$

$$Tc/3 \leqq t2 \leqq Tc \quad \text{(B)}$$

where Tc is a Helmholtz period of a natural vibration period generated in the liquid in the pressure chamber.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, embodiments of the invention will be described referring to the accompanying drawings. It is to be noted that although the following embodiments include various limitations as preferable examples of the invention, the scope of the invention is not limited to the embodiments unless otherwise stated in the following description. Hereunder, a liquid ejecting apparatus according to the invention will be exemplified by an ink jet recording apparatus (hereinafter simply printer).

First Embodiment

Figure 1:
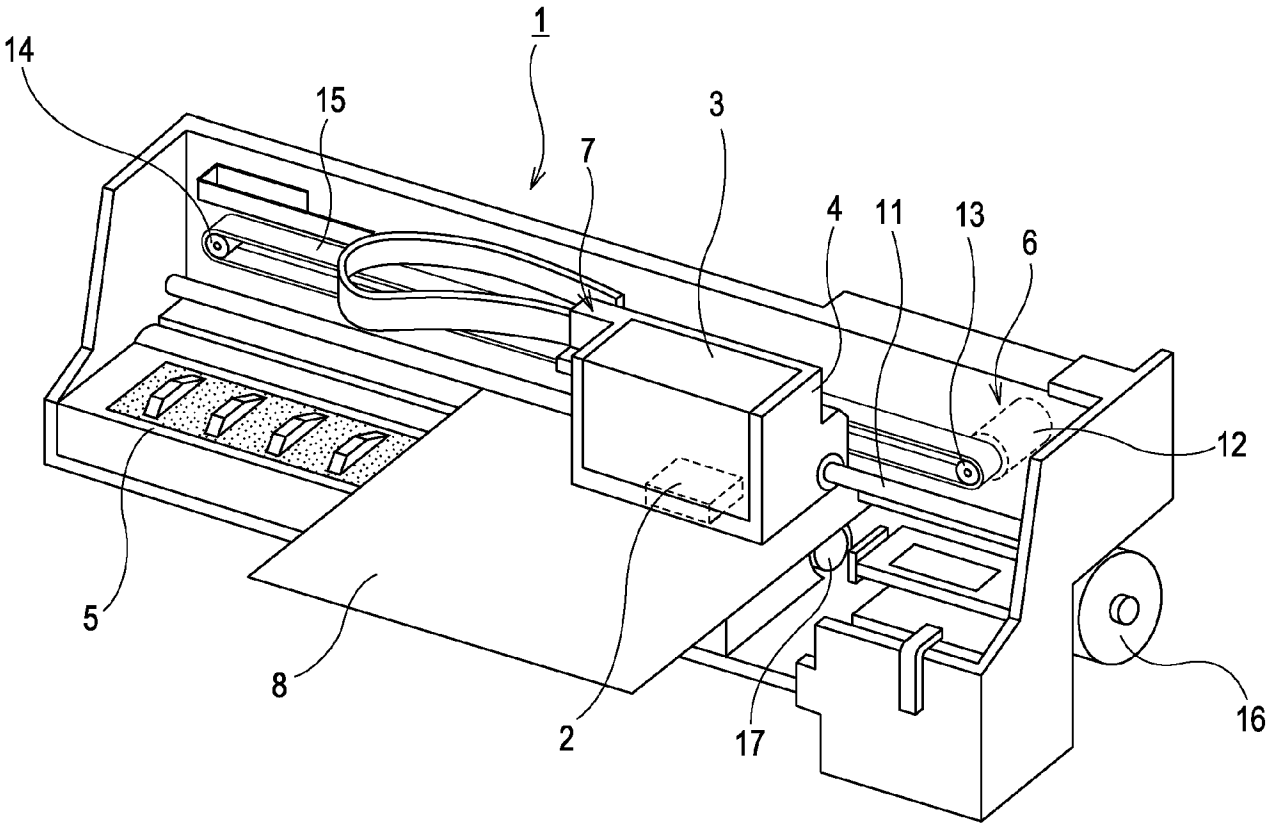
FIG. 1 is a perspective view illustrating an internal structure of a printer according to the invention.

The printer 1 shown in FIG. 1 ejects an ink, an example of a liquid which may be used in association with the invention, onto a recording medium such as a recording paper sheet, a cloth, or a film. The recording medium is an example of the landing target on which the ejected liquid is to land. The printer 1 includes a carriage 4 on which a recording head 2 exemplifying the liquid ejection head is mounted, and an ink cartridge 3, an example of the liquid supply source, is removably mounted, a platen 5 disposed below the recording head 2, a carriage transport mechanism 6 that moves the carriage 4 in a direction of the width of a recording paper sheet 8 exemplifying the landing target, a linear encoder 7 that outputs an encoder pulse according to the movement of the carriage 4, and a paper feed mechanism 9 that transports the recording paper sheet 8 in a paper-feed direction.

The carriage transport mechanism 6 includes a guide shaft 11 disposed so as to extend in a main scanning direction of the printer 1 (width direction of the recording paper sheet 8), a carriage transport motor 12 installed at an end portion in the main scanning direction, a drive pulley 13 connected to a rotating shaft of the carriage transport motor 12 so as to be rotationally driven by the carriage transport motor 12, a free pulley 14 located on the other end portion in the main scanning direction opposite the drive pulley 13, and a timing belt 15 engaged between the drive pulley 13 and the free pulley 14 which is connected to the carriage 4. The carriage transport motor 12 serves as a driving source for the carriage transport mechanism 6, and may be constituted by a pulse motor or a DC motor, for example. The carriage transport motor 12 has its rotation speed and rotation direction controlled by a control unit 25 (see FIG. 2) that serves as a controller. The rotation of the carriage transport motor 12 drives the drive pulley 13 and the timing belt 15 to rotate, so that the carriage 4 moves in the width direction of the recording paper sheet 8 along the guide shaft 11. Thus, the recording head 2 mounted on the carriage 4 is caused to reciprocate in the main scanning direction under the control of the control unit 25. The linear encoder 7 outputs the encoder pulse (position control signal) on the basis of the scanning position of the carriage 4, as positional information in the main scanning direction.

The paper feed mechanism 9 includes a paper feed motor 16 that serves as a paper feed driving source, and a paper feed roller 17 rotationally driven by the paper feed motor 16. The paper feed roller 17 according to this embodiment includes a pair of rollers which are disposed opposite to each other in the vertical direction. More specifically, the paper feed roller 17 includes a drive roller located on the lower side and a slave roller (not shown) on the upper side. The drive roller is located in the platen 5 with an upper circumferential surface thereof exposed through an upper surface of the platen 5, and the slave roller is superposed on the exposed surface of the drive roller. The paper feed roller 17 transports the recording paper sheet 8 in the paper feed direction, by rotating the drive roller with the recording paper sheet 8 pinched between the slave roller and the drive roller.

Figure 2:
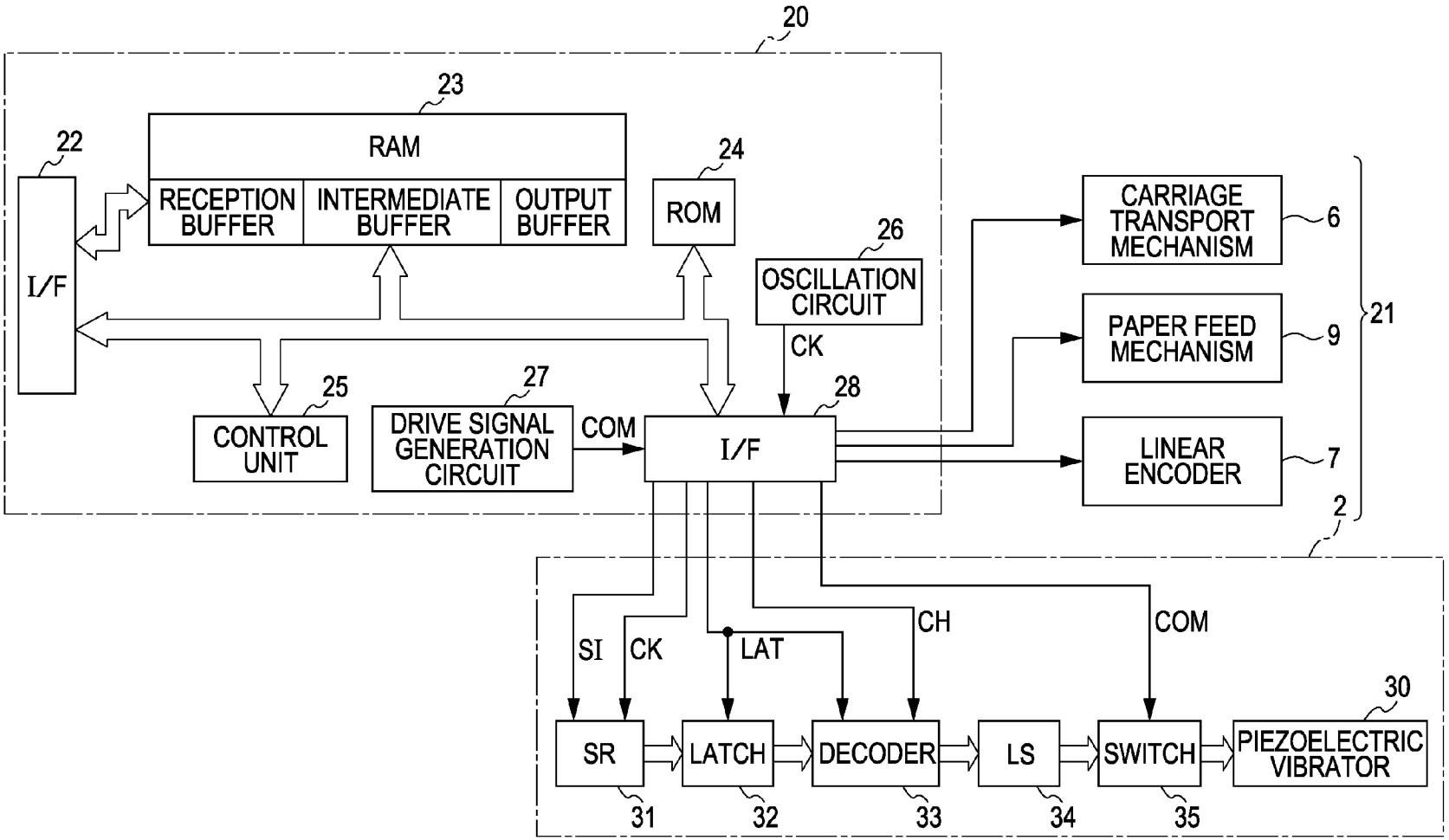
FIG. 2 is a block diagram illustrating a printing system according to the invention.

FIG. 2 is a block diagram for explaining an electrical configuration of the printer 1.

The printer 1 can be outlined as being constituted by a printer controller 20 and a print engine 21. The printer controller 20 includes an external interface (external I/F) 22 through which data transmission/reception is executed with an external device such as a host computer, a RAM 23 that stores various data therein, a ROM 24 that stores control routines for processing various data, a control unit 25 that controls each component, an oscillation circuit 26 that generates a clock signal, a drive signal generation circuit 27, an example of the ejection pulse generator according to the invention, that generates a drive signal to be provided to the recording head 2, and an internal interface (internal I/F) 28 through which dot pattern data and the drive signal are outputted to the recording head 2.

The control unit 25 converts, in addition to controlling each component, print job data received from the external device through the external I/F 22 into dot pattern data, and outputs the dot pattern data to the recording head 2 through the internal I/F 28. The dot pattern data is composed of printing data obtained by decoding (translating) gradation data. The control unit 25 also provides a latch signal and a channel signal to the recording head 2, on the basis of the clock signal from the oscillation circuit 26. A latch pulse and channel pulse contained in the latch signal and channel signal determine a timing for providing the pulses constituting the drive signal.

The drive signal generation circuit 27 generates the drive signal for driving a piezoelectric vibrator 30, under the control of the control unit 25. The drive signal generation circuit 27 according to this embodiment serves to generate the ejection pulse for ejecting an ink droplet, an example of the liquid droplet, thereby forming a dot on the recording paper sheet 8, and to generate a drive signal COM including, in a recording period, a micro-vibration pulse for causing a free surface of the ink exposed in a nozzle 50 (see FIG. 3), namely a meniscus, to micro-vibrate thereby agitating the ink.

A configuration of the print engine 21 will now be described. The print engine 21 includes the recording head 2, the carriage transport mechanism 6, the paper feed mechanism 9, and the linear encoder 7. The recording head 2 includes a shift register (SR) 31, a latch 32, a decoder 33, a level shifter (LS) 34, a switch 35, and the piezoelectric vibrator 30. The dot pattern data SI from the printer controller 20 is serially transmitted to the shift register 31 in synchronization with the clock signal CK from the oscillation circuit 26. The dot pattern data is 2-bit data, and composed of gradation information representing, for example, four recording gradations (ejection gradations) corresponding to no-recording (micro-vibration), a small dot, a medium dot, and a large dot. More specifically, the no-recording is expressed as gradation information "00", the small dot as gradation information "01", the medium dot as gradation information "10", and the large dot as gradation information "11".

The latch 32 is electrically connected to the shift register 31, so that once the latch signal (LAT) from the printer controller 20 is inputted to the latch 32, the dot pattern data in the shift register 31 is latched. The dot pattern data latched by the latch 32 is inputted to the decoder 33. The decoder 33 translates the dot pattern data of 2 bits and generates pulse selection data. The pulse selection data is formed by associating the respective bits to a pulse constituting the drive signal COM. Then selection is made on whether to provide the ejection pulse to the piezoelectric vibrator 30 in accordance with what the bit represents, for example "0" or "1".

The decoder 33 outputs the pulse selection data to the level shifter 34, upon receipt of the latch signal (LAT) or the channel signal (CH). In this case, the pulse selection data is sequentially inputted to the level shifter 34 from an upper bit. The level shifter 34 serves as a voltage amplifier, and outputs, in the case where the pulse selection data is "1", an electrical signal of a voltage boosted to a level that can drive the switch 35, for example, tens of volts. The pulse selection data of "1" boosted by the level shifter 34 is provided to the switch 35. The drive signal COM from the drive signal generation circuit 27 is provided to an input terminal of the switch 35, and the piezoelectric vibrator 30 is connected to the output terminal of the switch 35.

Then the pulse selection data controls an action of the switch 35, in other words provision of the drive pulse in the drive signal to the piezoelectric vibrator 30. For example, in a period where the pulse selection data inputted to the switch 35 is "1", the switch 35 becomes ON so that the corresponding ejection pulse is provided to the piezoelectric vibrator 30, and a potential level of the piezoelectric vibrator 30 fluctuates following the waveform of the ejection pulse. In contrast, in a period where the pulse selection data is "0", the level shifter 34 does not output the electrical signal for activating the switch 35. Accordingly the switch 35 is disconnected and the ejection pulse is not provided to the piezoelectric vibrator 30.

The decoder 33, the level shifter 34, the switch 35, the control unit 25, and the drive signal generation circuit 27 thus configured serve as an ejection controller, which selects the necessary ejection pulse from the drive signal on the basis of the dot pattern data, and applies (provides) the selected ejection pulse to the piezoelectric vibrator 30. As a result, the piezoelectric vibrator 30 stretches or contracts, so that the pressure chamber 48 (see FIG. 3) expands or contracts in response to the expansion or contraction of the piezoelectric vibrator 30, and the ink droplet of an amount corresponding to the gradation information constituting the dot pattern data is ejected through the nozzle 50.

Figure 3:
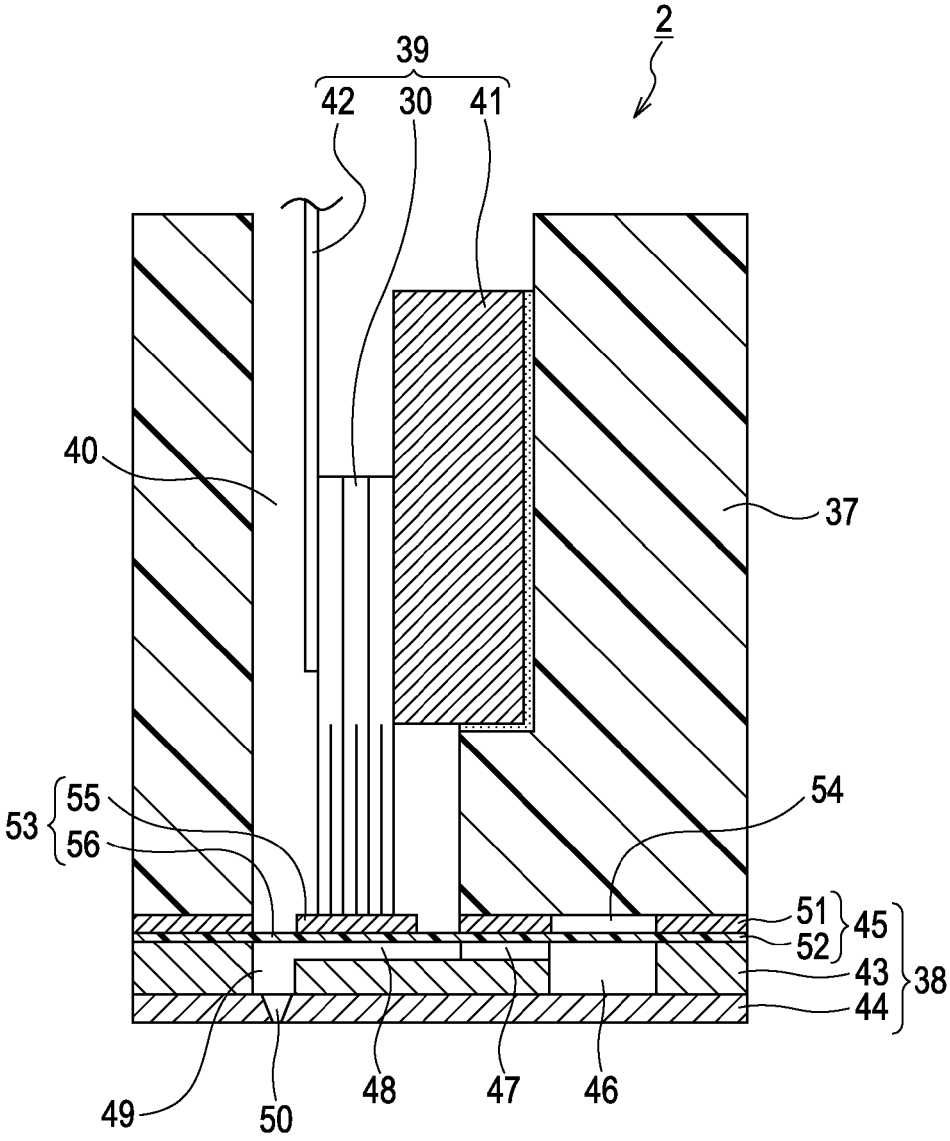
FIG. 3 is a cross-sectional view illustrating an essential portion of a recording head according to the invention.

FIG. 3 is a cross-sectional view showing an essential portion of the recording head 2. The recording head 2 includes a case 37, a vibrator unit 39 accommodated in the case 37, and a flow path unit 38 connected to a bottom face (end face) of the case 37. The case 37 is, for example, made of an epoxy resin and includes a hollow chamber 40 in which the vibrator unit 39 is accommodated. The vibrator unit 39 includes the piezoelectric vibrator 30 that serves as a pressure generator, a fixing plate 41 to which the piezoelectric vibrator 30 is attached, and a flexible cable 42 through which the drive signal is provided to the piezoelectric vibrator 30. The piezoelectric vibrator 30 has a multilayer structure constituted by a piezoelectric plate including alternately stacked piezoelectric layers and electrode layers, which are cut in a comb-like shape, and comprises a vertical vibration vibrator (transverse field effect vibrator) that can expand and contract in a direction orthogonal to the stacking direction (field direction).

The flow path unit 38 is constituted by a flow path substrate 43, a nozzle plate 44 attached to a surface thereof, and a vibration plate 45 attached to the other surface. The flow path unit 38 includes a reservoir 46 (shared liquid chamber), an ink channel 47, the pressure chamber 48, a nozzle channel 49, and the nozzle 50. Thus, a continuous ink flow path ranging from the ink channel 47 to the nozzle 50 through the pressure chamber 48 and the nozzle channel 49 is provided for each nozzle 50.

The nozzle plate 44 is a thin plate made of a metal such as a stainless steel, perforated with a plurality of nozzles 50 in a row at a pitch corresponding to the dot forming density (for instance, 180 dpi). On the nozzle plate 44, the nozzles 50 are aligned so as to form a plurality of nozzle rows (nozzle groups), and one of the nozzle rows includes, for example, 180 of the nozzles 50.

The vibration plate 45 is of a double-layer structure including a base plate 51 and an elastic layer 52 superposed over a surface thereof. In this embodiment, the vibration plate 45 is a composite plate constituted by a stainless steel plate, an example of the metal, employed as the base plate 51, and a resin film applied to a surface thereof to form the elastic layer 52. The vibration plate 45 includes a diaphragm portion 53 that changes the volume of the pressure chamber 48. The vibration plate 45 also includes a compliance portion 54 that closes a part of the reservoir 46.

The diaphragm portion 53 may be formed by partially removing the base plate 51 by an etching process or the like. The diaphragm portion 53 includes an island portion 55 to which a tip portion of a free end of the piezoelectric vibrator 30 is connected, and a thinner elastic portion 56 disposed around the island portion 55. The compliance portion 54 may be formed by partially removing the base plate 51 at a region opposing the opening of the reservoir 46, by an etching process or the like as in the case of forming the diaphragm portion 53. The compliance portion 54 serves as a damper that absorbs pressure fluctuation of the liquid stored in the reservoir 46.

Since the tip portion of the piezoelectric vibrator 30 is connected to the island portion 55, expanding or contracting the free end of the piezoelectric vibrator 30 allows the volume of the pressure chamber 48 to be changed. Such a change in volume creates pressure fluctuation of the ink in the pressure chamber 48. Then, the recording head 2 causes the ink droplet to be ejected through the nozzle 50 utilizing the pressure fluctuation thus created.

Figure 4:
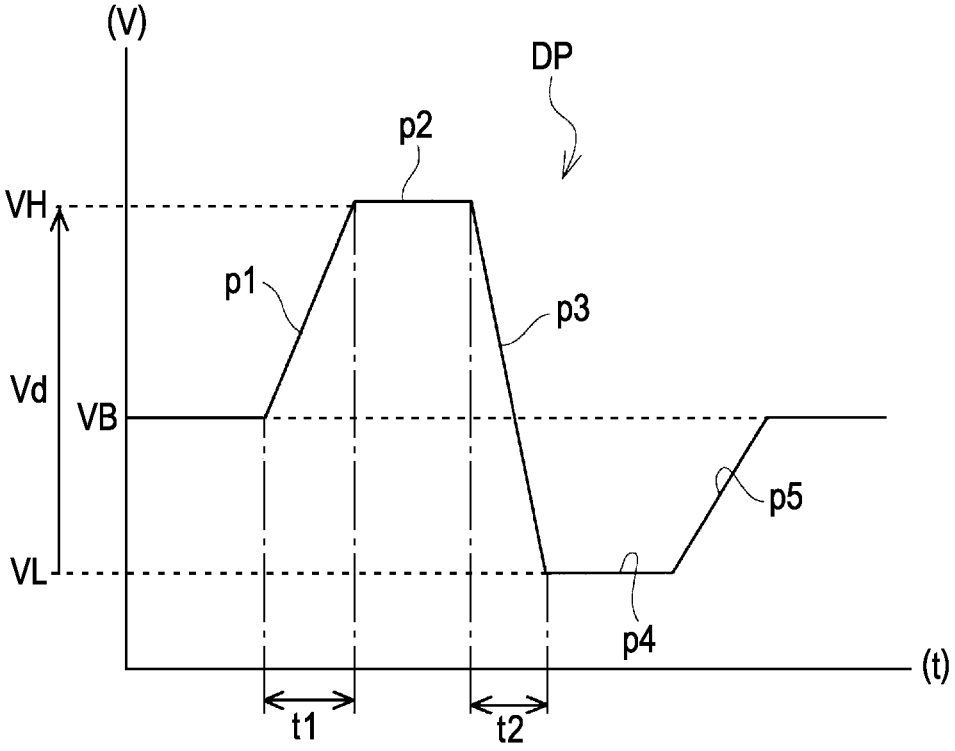
FIG. 4 is a wave diagram for explaining a configuration of an ejection pulse according to the invention.

FIG. 4 is a wave diagram for explaining a configuration of the ejection pulse DP contained in the drive signal COM generated by the drive signal generation circuit 27. The ejection pulse DP includes an expansion phase p1 (corresponding to the first voltage change phase according to the invention) where a potential is increased in a constant slope from a reference potential VB corresponding to a reference volume with respect to expansion and contraction of the volume of the pressure chamber 48 to an expansion potential VH, so as to cause the pressure chamber 48 to expand from the reference volume to an expanded volume, an expansion hold phase p2 (corresponding to the hold phase according to the invention) where the expansion potential VH is maintained in order to hold the expanded state of the pressure chamber 48 for a predetermined period, a contraction phase p3 (corresponding to the second voltage change phase according to the invention) where the potential is decreased at a constant slope from the expansion potential VH to a contraction potential VL, so as to cause the pressure chamber 48 to contract to a contracted volume, a contraction hold phase p4 where the contraction potential VL is maintained in order to hold the contracted state of the pressure chamber 48, and a reset phase p5 where the potential is increased at a constant slope from the contraction potential VL to the reference potential VB, so as to cause the pressure chamber 48 to expand to restore the reference volume.

The ejection pulse DP may be optimized for ejection of a liquid having a high viscosity in a range between 8 mPa·s and 30 mPa·s, such as a UV-curable ink. Hereafter, description will be given under the assumption that an ink having a high viscosity is to be ejected. To be more specific, the ejection pulse DP may be specified such that the following formulae are satisfied with respect to a time width t1 between a start edge of the expansion phase p1 and an end edge thereof, and a time width t2 between a start edge of the contraction phase p3 and an end edge thereof, where Tc represents a Helmholtz period of the vibration (natural vibration period) generated in the ink in the pressure chamber 48:

$$Tc/3 \leqq t1 \leqq Tc \quad \text{(A)}$$

$$Tc/3 \leqq t2 \leqq Tc \quad \text{(B)}$$

With respect to the time width t2 corresponding to the contraction phase p3, it is more preferable that the following formula is satisfied:

$$Tc/2 \leqq t2 \leqq Tc \quad \text{(C)}$$

In this embodiment, the time width t2 is specified as 3Tc/4.

Here, Tc may generally be expressed by the following formula (1):

$$Tc = 2\pi\sqrt{[(Mn+Ms)/(Mn \times Ms \times (Cc+Ci))]} \quad (1)$$

In the formula (1) above, Mn represents an inertance of the nozzle 50 (mass of the ink per unit sectional area), Ms an inertance of the ink channel 47, Cc a compliance of the pressure chamber 48 (volume fluctuation per unit pressure, indicating a degree of softness), and Ci a compliance of the ink (Ci=volume V/[density ρ×sound velocity $c^2$]).

In the case where the time widths t1, t2 are specified at a value exceeding Tc, a sufficient pressure fluctuation cannot be given to the ink in the pressure chamber 48 when driving the piezoelectric vibrator 30 with the ejection pulse DP thereby ejecting the ink through the nozzle 50, and hence a desired ejection characteristic (intended ink weight and flying speed based on the design and specification) cannot be attained. In this case, it becomes necessary to increase the drive voltage Vd of the ejection pulse DP (potential difference between the potential VL which is lowest and the potential VH which is highest). Conversely, in the case where the time widths t1, t2 are specified at a value below Tc/3, a boundary layer, i.e., a portion close to the inner wall of the nozzle 50 in the meniscus moving in the nozzle 50 in response to the pressure fluctuation, and highly susceptible to the viscosity of the ink itself, fails to follow the pressure fluctuation, which leads to an increase in speed difference between a central portion and the boundary layer of the meniscus, resulting in a stretched tail drag of the ink droplet ejected through the nozzle 50. With respect to the time width t2 corresponding to the contraction phase p3, setting the value so as to satisfy the formula (C) above prevents the drive voltage Vd of the ejection pulse DP from becoming excessively high, and ensures that a desired flying characteristic is attained.

FIGS. 5A to 5D are schematic drawings showing a transition in shape of the meniscus, through a period in which the ejection pulse DP is applied to the piezoelectric vibrator 30 so that the ink is ejected through the nozzle 50. Arrows in these drawings indicate the moving direction of the meniscus, and a length of the arrow is generally proportional to the moving speed of the meniscus. Also, an upper side of each drawing is oriented toward the pressure chamber 48, and a lower side toward the landing target.

Figure 5A:
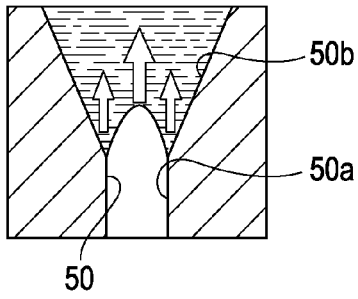
FIGS. 5A to 5D are schematic drawings illustrating how a liquid is ejected through a nozzle by the ejection pulse according to the invention.
Figure 5B:
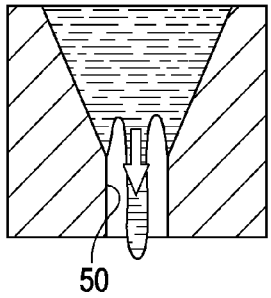
Figure 5C:
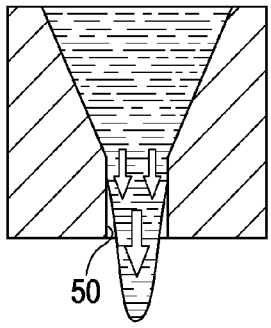

First, the piezoelectric vibrator 30 contracts in the expansion phase p1, so that the pressure chamber 48 expands from the reference volume corresponding to the reference potential VB to the expanded volume determined by the highest potential VH (expansion process). In response to this, the meniscus is prominently drawn inwardly toward the pressure chamber 48 as shown in FIG. 5A. Here, since the time width t1 of the expansion phase p1 is specified so as to satisfy the formula (A) above, the boundary layer effectively follows the central portion, and the entirety of the meniscus can be inwardly drawn toward the pressure chamber 48. Such an expanded state of the pressure chamber 48 is maintained throughout the period corresponding to the expansion hold phase p2 (expansion hold process). At a timing that the entire meniscus has been inwardly drawn so as to surpass a boundary between a straight portion 50*a* where the inner diameter of the nozzle 50 is constant and a tapered portion 50*b* where the inner diameter of the nozzle 50 gradually increases toward the pressure chamber 48, the contraction phase p3 is applied to the piezoelectric vibrator 30, so that the piezoelectric vibrator 30 stretches and the volume of the pressure chamber 48 is reduced from the expanded volume to the contracted volume determined by the lowest potential VL (contraction process). Such contraction of the pressure chamber 48 applies a pressure to the ink in the pressure chamber 48. Accordingly, the meniscus is squeezed out in the ejection direction away from the pressure chamber 48, and the central portion of the meniscus, which easily follows the pressure fluctuation, swells in a column shape, as shown in FIG. 5B (hereinafter referred to as column-shaped portion). Here, since the time width t2 of the contraction phase p3 is specified so as to satisfy the formula (B) above (more preferably, the formula (C) above, the entire meniscus can be squeezed out in the ejection direction, suppressing an increase in difference in moving speed between the central portion (column-shaped portion) and the boundary layer of the meniscus (see FIG. 5C).

Figure 5D:
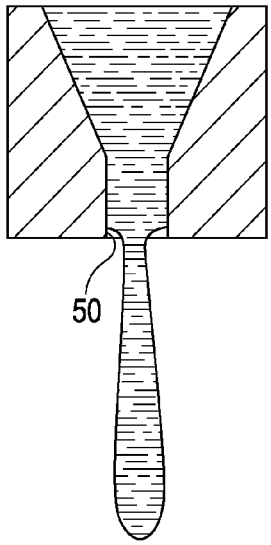

The contracted state of the pressure chamber 48 is maintained throughout the period corresponding to the contraction hold phase p4. Thereafter, the column-shaped portion prominently extends in the ejection direction, as shown in FIG. 5D. The column-shaped portion is separated from the meniscus at a base portion thereof, and the separated portion is ejected from the nozzle 50 as the ink droplet. Following the contraction hold phase p4, at a timing that the meniscus is squeezed in the ejection direction after once being inwardly drawn toward the pressure chamber 48 by a reaction of the ejection of the ink droplet, the reset phase p5 is applied to the piezoelectric vibrator 30. In response to this, the pressure chamber 48 expands from the contracted volume to the reference volume (reset process). As a result, residual vibration of the meniscus can be suppressed.

Thus, employing the ejection pulse DP according to the invention for executing the ejection can effectively suppress stretching of the tail drag formed in the rear end portion of the ink droplet with respect to the ejection direction, while securing a desired ejection characteristic even in the case of employing a high-viscosity ink. Even though the tail is separated from the main portion of the ink droplet, emergence of fine mist can be suppressed, and the dot can be prevented from being torn apart.

Figure 6A:
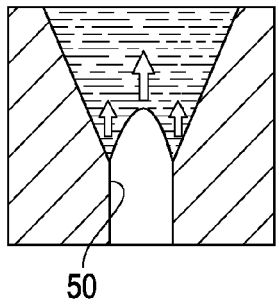
FIGS. 6A to 6D are schematic drawings illustrating how a liquid is ejected through a nozzle by an unimproved ejection pulse.
Figure 6B:
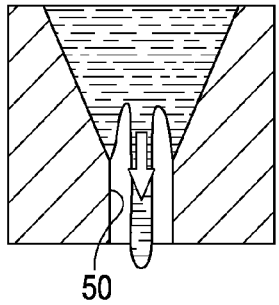
Figure 6C:
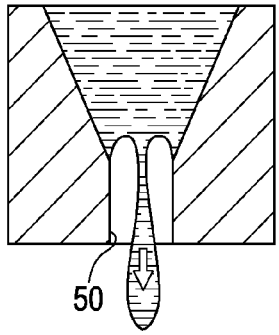
Figure 6D:
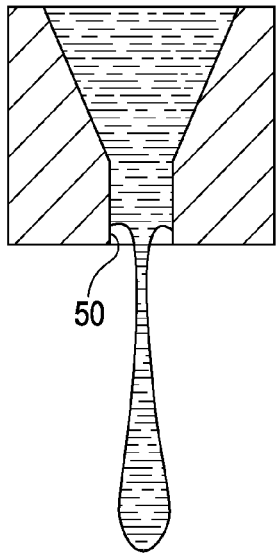

On the contrary, in the case where the time width t1 of the expansion phase p1 and the time width t2 of the contraction phase p3 are specified as a value below Tc/3 (for instance, Tc/4), the meniscus assumes generally the same shape as FIG. 5A up to the expansion process and the expansion hold process as shown in FIG. 6A, however in the contraction process, the pressure chamber 48 abruptly contracts from the expanded volume to the contracted volume in response to the contraction phase p3. Accordingly, the boundary layer fails to follow up the column-shaped portion formed in the central portion of the meniscus, which easily follows the pressure fluctuation, as shown in FIGS. 6B and 6C, and hence the column-shaped portion becomes longer than that formed by the ejection pulse DP according to the invention, as shown in FIG. 6D. Accordingly, when the column-shaped portion is separated from the meniscus at the base portion and ejected from the nozzle 50 as the ink droplet, the tail portion is prone to be torn apart from the main portion of the ink droplet, and the portion torn away is prone to turn into fine mist. In the case where the portion that has turned into mist lands on the landing target, such as the recording paper sheet 8, at a position spaced from the main portion of the ink droplet, the quality of the recorded image may be degraded.

It is to be noted that the invention is not limited to the foregoing embodiment, but may be modified in various manners within the scope of the appended claims.

Although the ejection pulse according to the invention is exemplified by the ejection pulse DP shown in FIG. 4 in the foregoing embodiment, an ejection pulse having a different shape may be employed.

Second Embodiment

A second embodiment is similar to the first embodiment, unless otherwise stated specifically.

Figure 7:
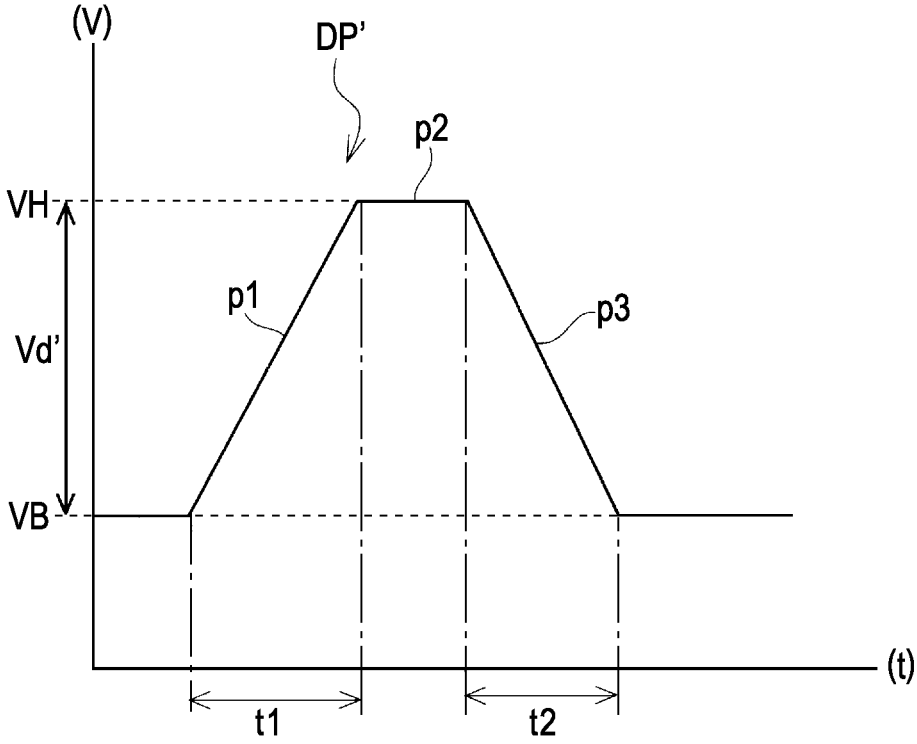
FIG. 7 is a wave diagram for illustrating a configuration of an ejection pulse according to a second embodiment of the invention.

FIG. 7 is a wave diagram showing a configuration of an ejection pulse DP' according to the second embodiment. The ejection pulse DP' according to the second embodiment includes the expansion phase p1 where the potential is increased from the reference potential VB corresponding to the contracted volume of the pressure chamber 48 to the expansion potential VH, so that the pressure chamber 48 expands from the contracted volume to the expanded volume, the expansion hold phase p2 where the expansion potential VH is maintained for holding the expanded state of the pressure chamber 48 for a predetermined period, and the contraction phase p3 where the potential is decreased from the expansion potential VH to the reference potential VB, so that the pressure chamber 48 contracts to the contracted volume. The ejection pulse DP' is different from the ejection pulse DP according to the first embodiment, in that the difference in potential between the start edge and the end edge of the expansion phase p1 and the difference in potential between the start edge and the end edge of the contraction phase p3 are the same, being the drive voltage Vd' specified by the ejection pulse DP', and that the contraction hold phase p4 and the reset phase p5 are not included. The configuration of the remaining portion is the same as that of the first embodiment, and hence description thereof will not be repeated.

In the ejection pulse DP' according to this embodiment also, the time width t1 between the start edge and the end edge of the expansion phase p1, and the time width t2 between the start edge and the end edge of the contraction phase p3 are specified so as to satisfy the foregoing formulae (A) and (B). Employing the ejection pulse DP' for ejecting the high-viscosity ink can also effectively suppress the stretching of the tail drag formed in the rear end portion of the ink droplet with respect to the ejection direction, while securing a desired ejection characteristic, as with the ejection pulse DP according to the first embodiment.

Although the pressure generator is exemplified by what is known as the vertical vibration type piezoelectric vibrator 30 in the foregoing embodiments, for example what is known as a flexural vibration type piezoelectric vibrator may be employed instead. In this case, the waveform of the pulse represents a reversed fluctuation direction of the potential, in other words inverted upside down, with respect to the drive signal described above.

Further, the invention is also applicable, without limitation to the printer, to ink jet recording apparatuses such as a plotter, a facsimile machine, and a copier, and liquid ejecting apparatuses other than the ink jet recording apparatus such as display manufacturing equipment, electrode manufacturing equipment, chip manufacturing equipment, and the like, as long as the liquid ejecting apparatus allows the ejection to be controlled by an ejection pulse. In the case of the display manufacturing equipment, a solution of Red (R), Green (G), and Blue (B) is ejected from a color material ejection head. With the electrode manufacturing equipment, a liquid electrode material is ejected from an electrode material ejection head. With the chip manufacturing equipment, a bioorganic solution is ejected from a bioorganic ejection head.

What is claimed is:

1. A liquid ejecting apparatus comprising:

a liquid ejection head including a pressure chamber in which a liquid is stored, a nozzle communicating with the pressure chamber and through which the liquid is ejected, and a pressure generator that applies pressure fluctuation to the liquid stored in the pressure chamber; and an ejection pulse generator that generates an ejection pulse that drives the pressure generator, wherein the ejection pulse sequentially includes:

a first voltage change phase where a voltage is changed so as to expand the pressure chamber, a hold phase where an end edge potential of the first voltage change phase is maintained for a predetermined period, and a second voltage change phase where the voltage is changed so as to contract the pressure chamber expanded in the first voltage change phase, and wherein a time t1 between a start edge and the end edge of the first voltage change phase, and a time t2 between a start edge and an end edge of the second voltage change phase are specified in the following range:

$$Tc/3 \leqq t1 \leqq Tc \quad \text{(A)}$$

$$Tc/3 \leqq t2 \leqq Tc \quad \text{(B)},$$

where Tc represents a Helmholtz period of a natural vibration period generated in the liquid in the pressure chamber.

2. The liquid ejecting apparatus according to claim 1, wherein the time t2 corresponding to the second voltage change phase is specified so as to satisfy the following formula:

$$Tc/2 \leqq t2 \leqq Tc \quad \text{(C)}.$$

3. The liquid ejecting apparatus according to claim 1, wherein a viscosity of the liquid at the time of ejection through the nozzle is not lower than 8 mPa·s and not higher than 30 mPa·s.

4. A liquid ejecting head comprising:

a pressure chamber in which a liquid is stored, a nozzle communicating with the pressure chamber and through which the liquid is ejected, and a pressure generator that applies pressure fluctuation to the liquid stored in the pressure chamber; and an ejection pulse generator that generates an ejection pulse that drives the pressure generator, wherein the ejection pulse sequentially includes:

a first voltage change phase where a voltage is changed so as to expand the pressure chamber, a hold phase where an end edge potential of the first voltage change phase is maintained for a predetermined period, and a second voltage change phase where the voltage is changed so as to contract the pressure chamber expanded in the first voltage change phase, and wherein a time t1 between a start edge and the end edge of the first voltage change phase, and a time t2 between a start edge and an end edge of the second voltage change phase are specified in the following range:

$$Tc/3 \leqq t1 \leqq Tc \quad \text{(A)}$$

$$Tc/3 \leqq t2 \leqq Tc \quad \text{(B)},$$

where Tc represents a Helmholtz period of a natural vibration period generated in the liquid in the pressure chamber.

5. The liquid ejecting head according to claim 4, wherein the time t2 corresponding to the second voltage change phase is specified so as to satisfy the following formula:

$$Tc/2 \leqq t2 \leqq Tc \quad \text{(C)}.$$

6. The liquid ejecting head according to claim 4, wherein a viscosity of the liquid at the time of ejection through the nozzle is not lower than 8 mPa·s and not higher than 30 mPa·s.

* * * * *